US008251358B2

(12) United States Patent
Grolman

(10) Patent No.: US 8,251,358 B2
(45) Date of Patent: Aug. 28, 2012

(54) ACCESSORY FOR HOLDING DEVICE

(76) Inventor: Benyamin Grolman, Alno (SE)

( * ) Notice: Subject to any disclaimer, the term of this patent is extended or adjusted under 35 U.S.C. 154(b) by 330 days.

(21) Appl. No.: 12/530,374

(22) PCT Filed: Mar. 5, 2008

(86) PCT No.: PCT/SE2008/000180

§ 371 (c)(1),
(2), (4) Date: Sep. 8, 2009

(87) PCT Pub. No.: WO2008/111892

PCT Pub. Date: Sep. 18, 2008

(65) Prior Publication Data

US 2010/0090385 A1 Apr. 15, 2010

(30) Foreign Application Priority Data

Mar. 11, 2007 (SE) ..... 0700664

(51) Int. Cl.
*B25B 5/02* (2006.01)

(52) U.S. Cl. ..... 269/275; 269/8

(58) Field of Classification Search ..... 269/275, 269/8, 6, 3, 95

See application file for complete search history.

(56) References Cited

U.S. PATENT DOCUMENTS

| | | | | |
|---|---|---|---|---|
| 2,399,714 | A | 5/1946 | Wasilewski | |
| 3,811,668 | A * | 5/1974 | Kotter | 269/258 |
| 3,998,445 | A * | 12/1976 | Goltz | 269/258 |
| 4,134,578 | A * | 1/1979 | Stanley | 269/249 |
| 5,135,209 | A * | 8/1992 | Penny | 269/249 |
| 5,711,515 | A * | 1/1998 | Nishimura | 269/276 |
| 6,349,869 | B1 * | 2/2002 | McBee | 228/49.3 |
| 6,431,534 | B1 * | 8/2002 | Orosz et al. | 269/43 |
| 6,715,385 | B2 * | 4/2004 | Wu | 81/176.15 |

FOREIGN PATENT DOCUMENTS

| | | | |
|---|---|---|---|
| DE | 19845203 | A1 | 4/2000 |
| GB | 231718 | A | 4/1925 |
| WO | 9852719 | A1 | 11/1998 |
| WO | 2006075983 | A1 | 7/2006 |

* cited by examiner

*Primary Examiner* — Lee D Wilson

(74) *Attorney, Agent, or Firm* — Jeffrey S. Melcher; Manelli Selter PLLC

(57) ABSTRACT

Accessory (1) for a holding device, such as a vise, a clamp or the like intended for use in conjunction with the temporary attachment of at least one object with the aid of the holding device, in which the accessory (1) includes a body (2) having at least one groove (3) and at least one attachment device (4). The invention is distinguished by the groove (3) having at least one arch-shaped contact surface (5).

17 Claims, 21 Drawing Sheets

ACCESSORY FOR HOLDING DEVICE

CROSS-REFERENCE TO RELATED APPLICATIONS

This application is a national stage entry under 35 U.S.C. 371 of International Application No. PCT/SE2008/00180, filed 5 Mar. 2008, designating the United States. This application claims foreign priority under 35 U.S.C. 119 and 365 to Swedish Patent Application No. 0700664-6, filed 11 Mar. 2007.

TECHNICAL FIELD

The present invention concerns an accessory for a holding device such as a vise, clamp, clip (brace) or the like. More specifically the present invention regards an accessory, primarily intended to be used in pairs during fastening of an object in a vise, clamp, clip (brace) or the like in accordance with the claims.

BACKGROUND OF THE INVENTION

In many instances, such as for example during different kinds of machine working, there exists a need to fasten one or more objects in a safe and reliable manner. The use of vises, clamps or the like is a typical way of fastening objects. Existing devices such as vices, clamps or the like function well when fastening objects with a plane surface, but are not well suited for other forms such as objects that are round. Furthermore, it may be difficult to fasten angular-shaped (cornered) objects such as triangular-, pentagonal- or other polygonal-shaped objects, in a reliable and simple manner with existing devices.

A further problem when fastening a worked piece of material with existing fastening devices, is that these devices in many instances damage the object that is to be held in place. When working with tools or the like equipped with a sharp edge, such as for example a knife or the like, it is not possible to fasten the knife in a reliable manner without the risk of damaging the sharp edge. The jaws of existing vises will damage the sharp edge of a knife when secured. Existing designs of holding devices can not reliably fasten a knife without damaging the sharp edge of the knife.

In many situations there arises a need to fasten relatively larger objects and relatively smaller objects with one and the same vise, clamp or the like. Existing accessories for vises, clamps and the like do not allow for this. Existing jaws are not designed to fasten both relatively smaller and larger objects.

A further problem with existing designs of accessories for a holding device such as a clamp or vise is that it can be difficult to handle an object with one hand. With the present shape of the invention an object placed in the accessory allows for work to be carried out with both hands free. Furthermore, yet another problem is that many accessories to holding devices are only adapted for a specific clamp, vise or the like. Specifically developed accessories permit only limited possibilities of moving the accessory from one holding device to another. All types of gripping devices need to use at least three so called gripping vectors to hold an object steady (two pressing vectors and one reactor vector). When gripping in three dimensions there will be three axis of power. The two pressing vectors impose themselves on the object being gripped; meaning that the distance between them imposes the geometric size of the object. But different objects command different distances between the pressing vectors.

In regards to the above it is obvious that there exists a need of an improved accessory for vises, clamps and the like.

PRIOR ART

In order to simplify the fastening of objects, many different types of designs have been developed. One example of this kind of clamping device is described in patent document U.S. Pat. No. 4,134,578. The clamping device according to the patent document is comprised of two spring-loaded jaws with contact surfaces which are designed to be turnable toward and away from one another. The design allows only for limited adjustability in regards to the form of the piece to be worked. The design is comprised of many parts making it expensive to manufacture and its moving parts are susceptible to dust, shavings and other particles that are produced during working. The design does not solve the problem of firmly holding an object with a sharp edge such as for example a knife. Therefore the design differs significantly from the present invention.

Furthermore, via patent document U.S. Pat. No. 2,399,714 a kind of clamp is known which is intended for facilitating the clamping of two objects with one another. The design consists of a clamp equipped with contact surfaces of a specific form. The design is intended for example to be used for holding round objects. The design is unsuitable for firmly holding an object with a sharp edge and is therefore significantly different from the present invention.

Patent document GB231718 describes a variation of a clamp which consists of contact surfaces with a form that to some degree is similar to the present invention. However, the form of the contact surfaces differs significantly from the present invention and is not suitable for firmly holding an object equipped with a sharp edge or the like.

Patent document WO2006075983A1 describes a device and method of clamping bicycles in a mouth having a moveable jaw and a stationary jaw to which a high load potential may be utilized within a toggle joint and ratchet mechanism and a release may be triggered to open a mouth in a quick movement. Certain embodiments also contain a multi-sized object secured grip which may be located on a contact surface of a movable jaw and a stationary jaw to allow for universal gripping of various sized objects. These embodiments are however primarily designed for gripping round or round-shaped objects of a size that corresponds to the size normally used in bicycle designs. Very small or very large objects are not suited for these embodiments. These embodiments do for example not allow for secure holding of different cornered objects such as triangular- or pentagonal-shaped objects or objects of asymmetrical form. Nor do these embodiments allow for holding an object with a sharp edge in a manner which easily facilitates work being carried out on said object.

With regards to the description of the technical problems and the known art, there exists a need of a significantly improved variation of jaws equipped with contact surfaces in accordance with the present invention.

BRIEF DESCRIPTION OF THE INVENTION CONCEPT

The main purpose of the present accessory is to grip a huge variety of different sized objects of greatly varied geometrical shapes and a very wide range of geometrical figures. The main idea behind the present accessory is to achieve this purpose by using only one mechanical element such as for example a vise, a clamp or the like. Another purpose of the present invention is to improve the possibility of firmly holding objects equipped with a sharp edge or the like. Yet another purpose of the present invention is to create an accessory for a vise or clamp with which objects equipped with sharp edges of many dimensions may be firmly gripped.

DESCRIPTION OF THE INVENTION

The invention will be described in detail in the following text with reference to the enclosed schematic drawings that show the current most preferred embodiment of the invention.

Figure 1:
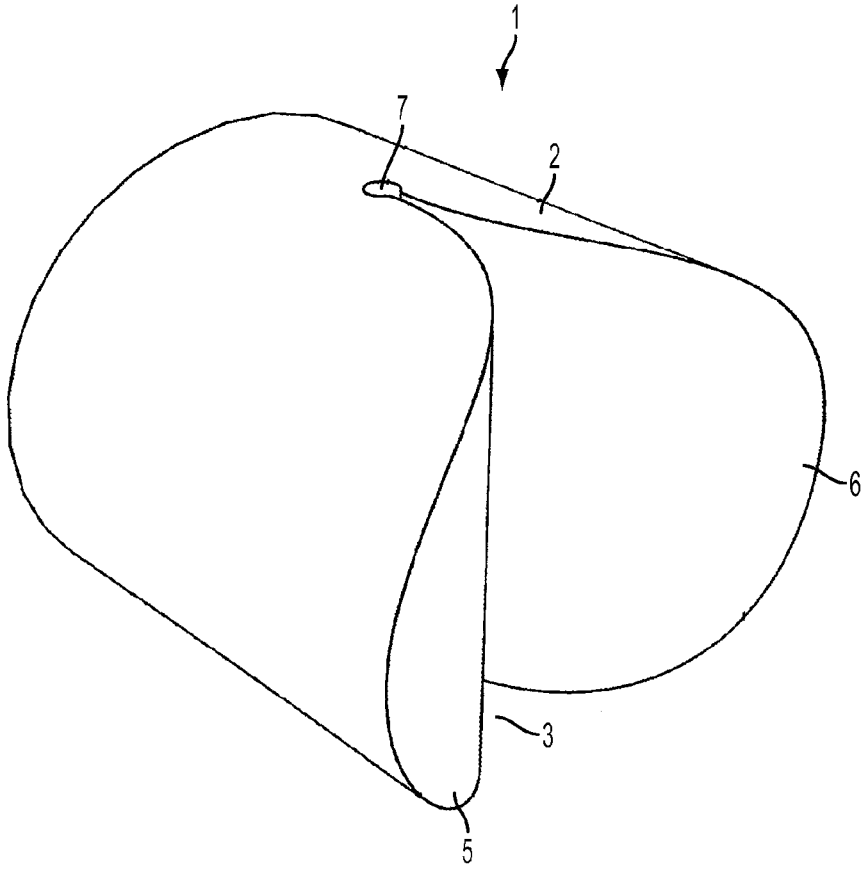
FIGS. 1-2 show in perspective a first embodiment of the present invention.

With reference to the drawings an accessory 1 is shown for a holding device such as a vise (not shown in the drawings), clamp or the like in accordance with the present invention. The accessory is preferably intended to be used in pairs in a vise, clamp or the like, but can within the scope of the invention be used singularly. The accessory consists of a body 2 fitted with at least one groove 3 and at least one attachment device 4 for temporarily or permanently attaching the accessory to the existing jaws of a vise, a clamp or the like.

The body 2 can be made-up of any material that is suitable for the purpose, such as for example a metallic or polymer material. An elastic material can preferably be utilized, which is flexible enough for the pressing-vectors' mutual distance (referred to as L) to shape itself after the object to be gripped. The material is also preferably elastic enough to return to its original shape after use. L is consecutive and responds to the object's size and shape, which is also as an outcome of the accessory's flexibility. Alternatively, some other earlier known material preferably with a flexible or elastic effect, suitable for the purpose may be used for the body 2. In FIG. 1 an accessory 1 is shown with a round circular outer form. The accessory 1 can in alternative embodiments be square, rectangular according to FIGS. 4 and 5 or essentially of whatever other form suitable for the respective area of use for the accessory 1. The accessory 1 consists of at least one groove 3. The groove 3 has a very specific form which allows for one and the same accessory 1 to be used for holding a variety of different objects of varying forms. An object with a sharp edge such as a knife blade or the like can for example be held firmly with the aid of a pair of the accessory 1 mounted in a vise or the like. In one preferred embodiment of the invention, the groove 3 is separated by a first contact surface 5 and a second contact surface 6. The contact surfaces 5 and 6 are preferably arch-shaped, said arch-shape stretching along the grooves' length. The contact surfaces 5 and 6 preferably have a radial form, such as the radial outside of a segment of a cylinder. In alternative embodiments the contact surfaces may be of an elliptical form or other arch-shaped form.

Figure 2:
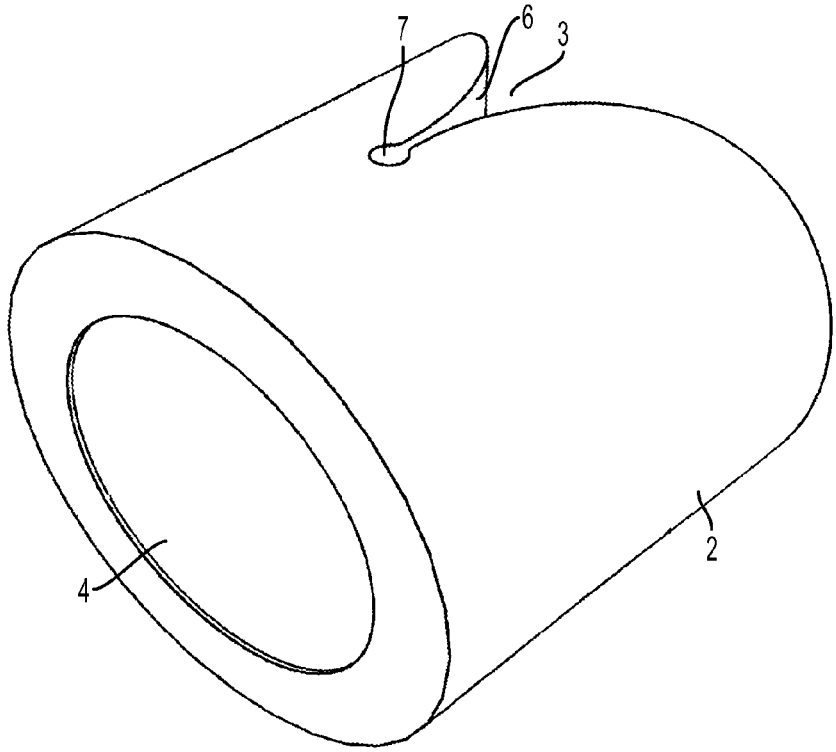
Figure 3:
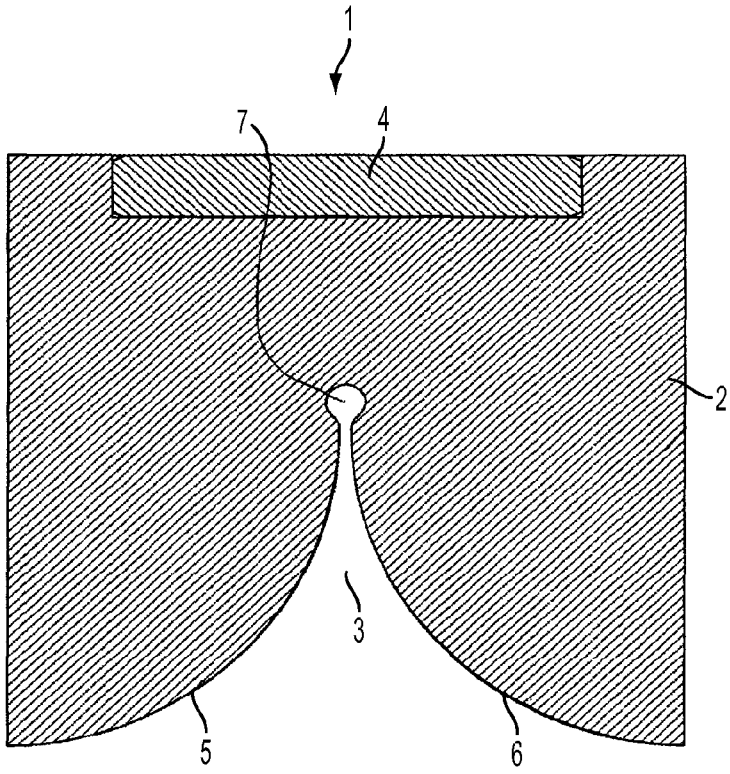
FIG. 3 shows a cross-section of the first embodiment of the present invention.

FIGS. 1 to 3 show the first embodiment of the present invention. The embodiment is preferably intended to be used in pairs and attached permanently or temporarily in a clamp. FIG. 3 shows a cross-section of the first embodiment that shows a first contact surface 5 and a second contact surface 6 which have the form of a segment of a circle. The first contact surface 5 and a second contact surface 6 are separated from one another by an in-between lying recess 7. The recess 7 allows for example the sharp edge of a knife to be clamped firmly with the aid of the accessory without the sharp edge being damaged. The recess 7 has preferably a round form but can be rectangular or other for the purpose suitable form. The round form is preferable because it significantly reduces the risk of developing cracks during transfer between contact surface 5 and contact surface 6.

Figure 4:
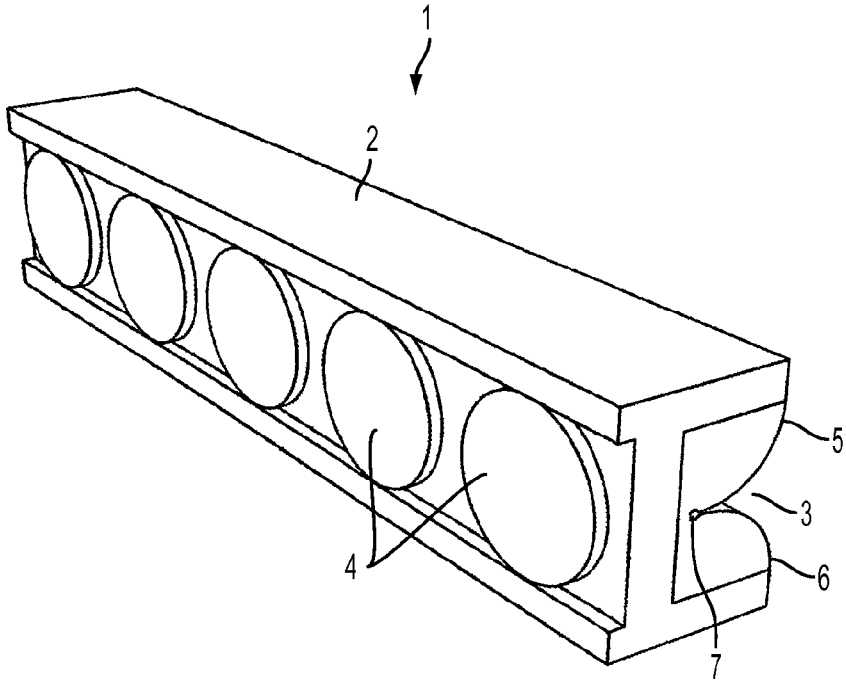
FIG. 4 shows in perspective a second embodiment of the present invention.
Figure 5:
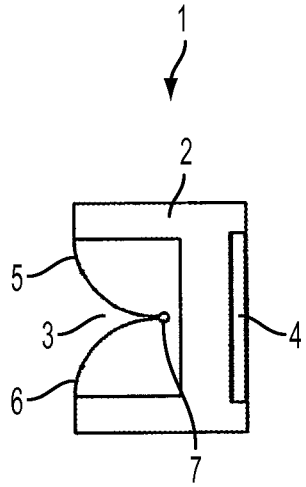
FIG. 5 shows a cross-section of the second embodiment of the present invention.

FIGS. 4 and 5 show a second embodiment of the present invention. The accessory according to the embodiment is intended to be used in a corresponding manner as a loose or permanent jaw in a vise (not shown in the figures) or the like. FIG. 4 shows more specifically a cross-section of the embodiment. In this embodiment the groove 3 receives an elongated form along the length of the jaw. In different variations of the accessory, which in this case is made-up of a jaw, the specific form acquires the technical effect that makes it very well suited for firmly holding elongated round or cornered objects. Furthermore an extremely advantageous possibility of firmly clamping an object such as an object equipped with a sharp edge such as a knife or the like is gained.

Figure 6:
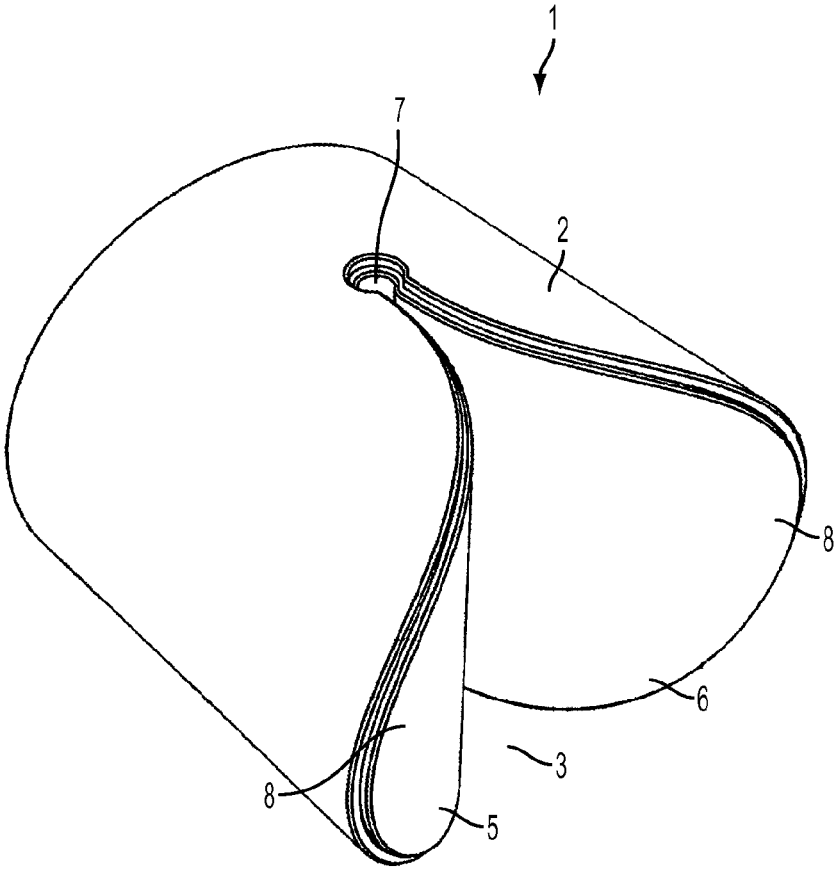
FIG. 6 shows a third embodiment of the present invention.

FIG. 6 shows a third embodiment of the present invention which is fitted with a protecting layer 8. The protecting layer 8 is intended to protect the object to be held with the aid of the accessory or to protect the inward body 2 in the accessory. The protecting layer 8 may be permanently fixed to the accessory or alternatively be exchangeable. The protecting layer 8 may in such cases where it is exchangeable be fitted with an adhesive material with which the protecting layer 8 can be temporarily attached to the accessory. The protecting layers' 8 characteristics may vary significantly between different applications. Thus the protecting layer 8 can essentially be made-up of a soft material such as a polymer material or the like. In other instances the material in the protecting layer may be of an essentially harder material than the body. Within the scope of the invention the material and characteristics of the protecting layer 8 may vary to a large extent.

Figure 7:
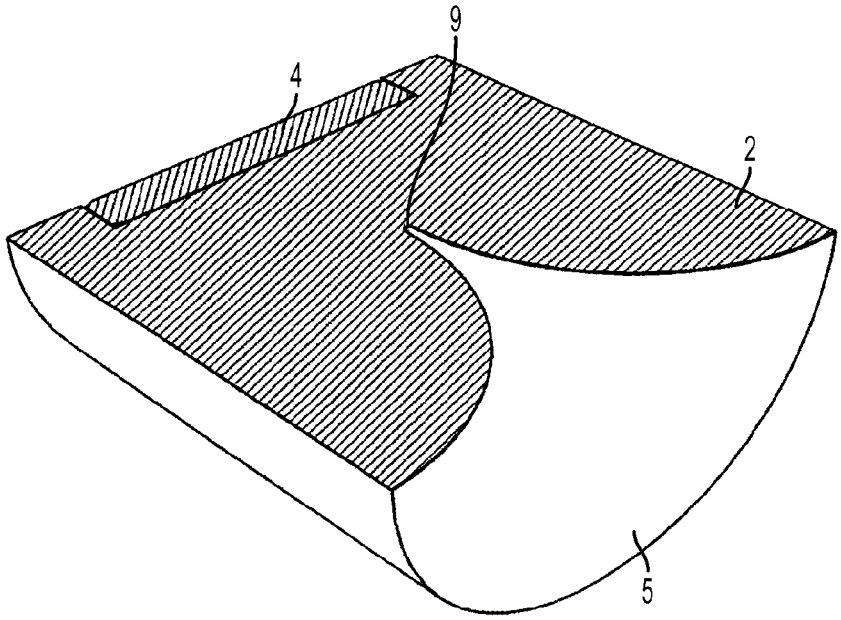
FIG. 7 shows a fourth embodiment of the present invention.

FIG. 7 shows a fourth embodiment of the present invention. In this embodiment the groove's length is limited to essentially being comprised of a point 9. In this embodiment the contact surface 5 essentially stretches (rounds) in a circular manner around point 9. This embodiment is especially suitable for holding the short ends of pipes (tubes), poles, rhombic shaped, conical shaped, rectangular shaped or any other shaped object.

Figure 8:
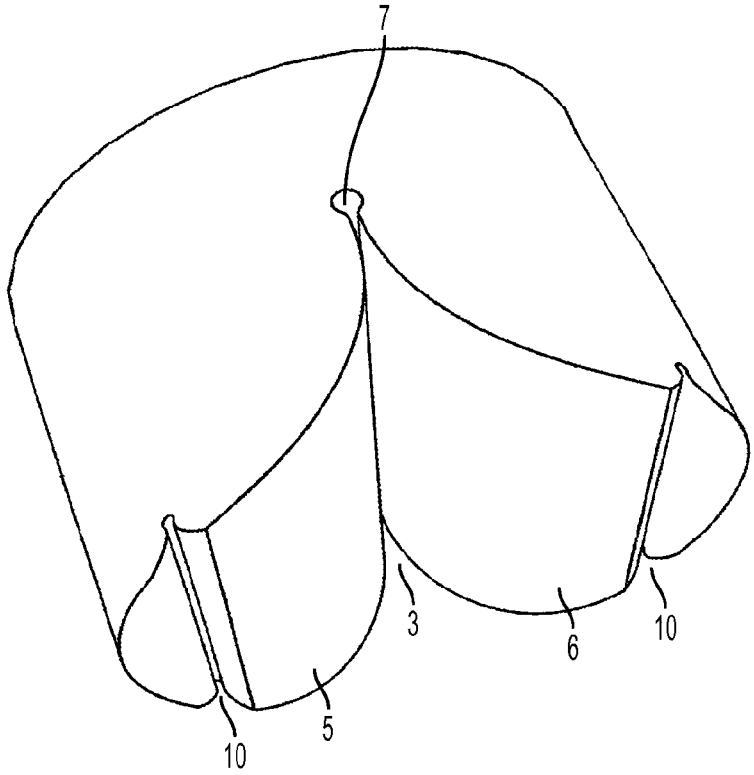
FIGS. 8-9 show a fifth embodiment of the present invention.
Figure 9:
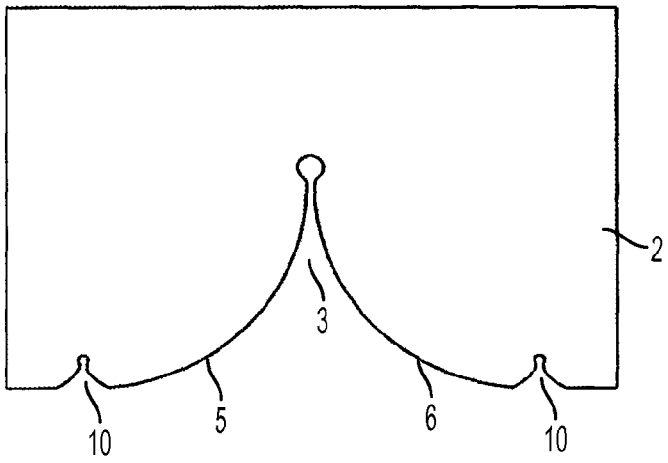

FIGS. 8 and 9 show a fifth embodiment of the present invention, which is preferably intended for use as an accessory to a clamp. In this embodiment the accessory is fitted with a first groove 3 and at least a second groove 10. FIGS. 8 and 9 show an accessory with two grooves 10 which are essentially parallel with groove 3.

Figure 10:
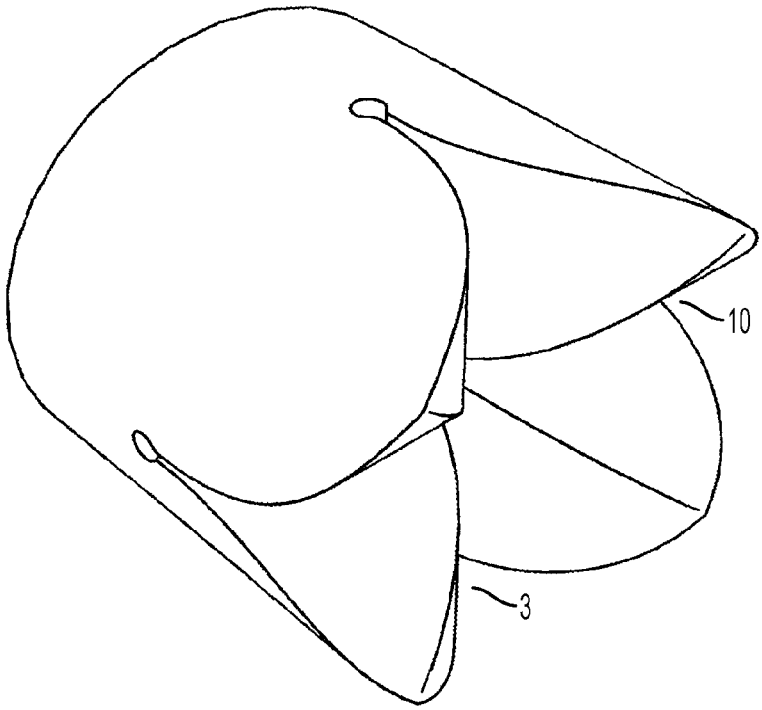
FIGS. 10-11 show a sixth embodiment of the present invention.
Figure 11:
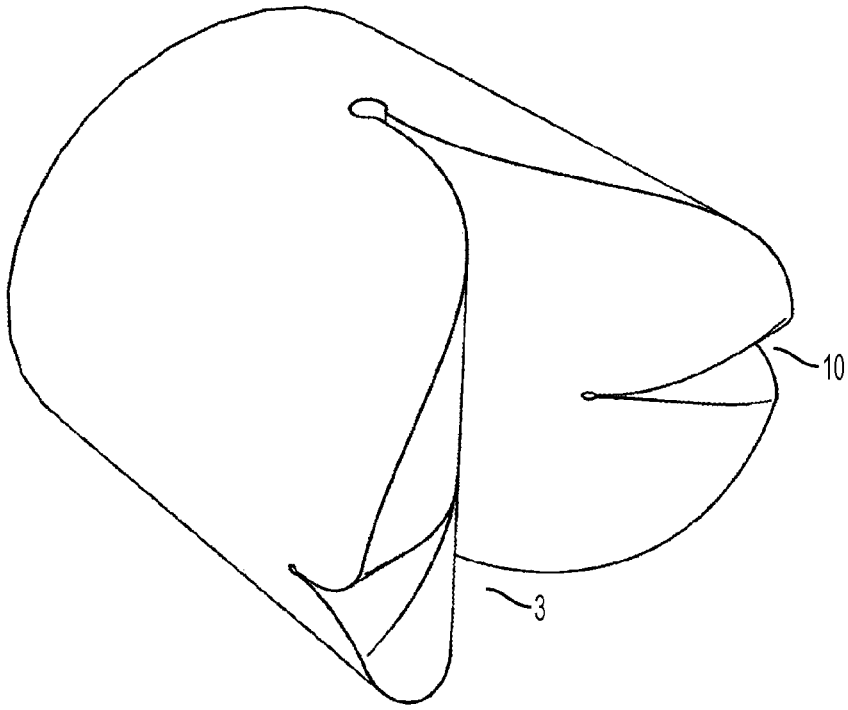

FIGS. 10 and 11 show a sixth embodiment where the groove 10 is preferably angled at 90 degrees in relation to groove 3. Within the scope of the invention this angle may vary if the use of the accessory demands another angle. This design allows for greater accessibility to an object held in the accessory. This embodiment is even suitable for holding pipes, poles or the like.

Figure 12:
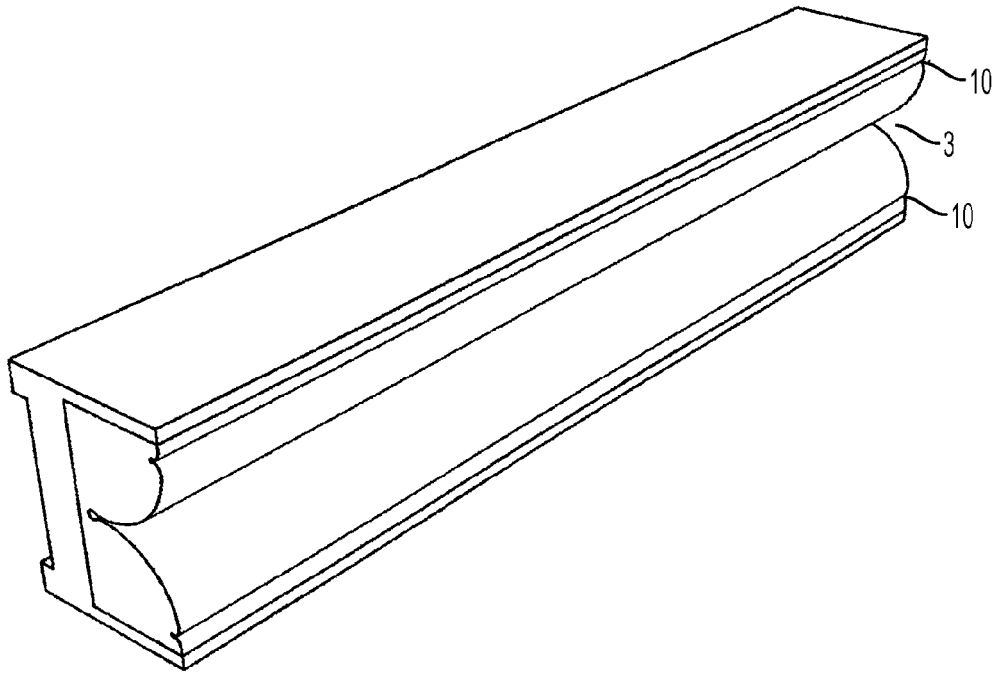
FIG. 12 show a seventh embodiment of the present invention.
Figure 13:
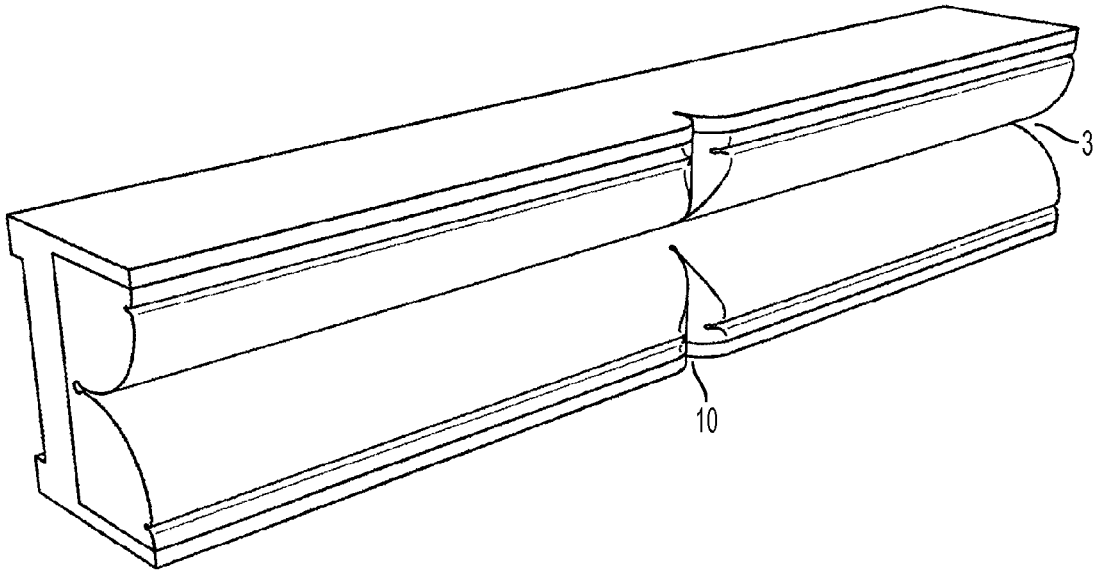
FIGS. 13-14 show an eighth embodiment of the present invention.
Figure 14:
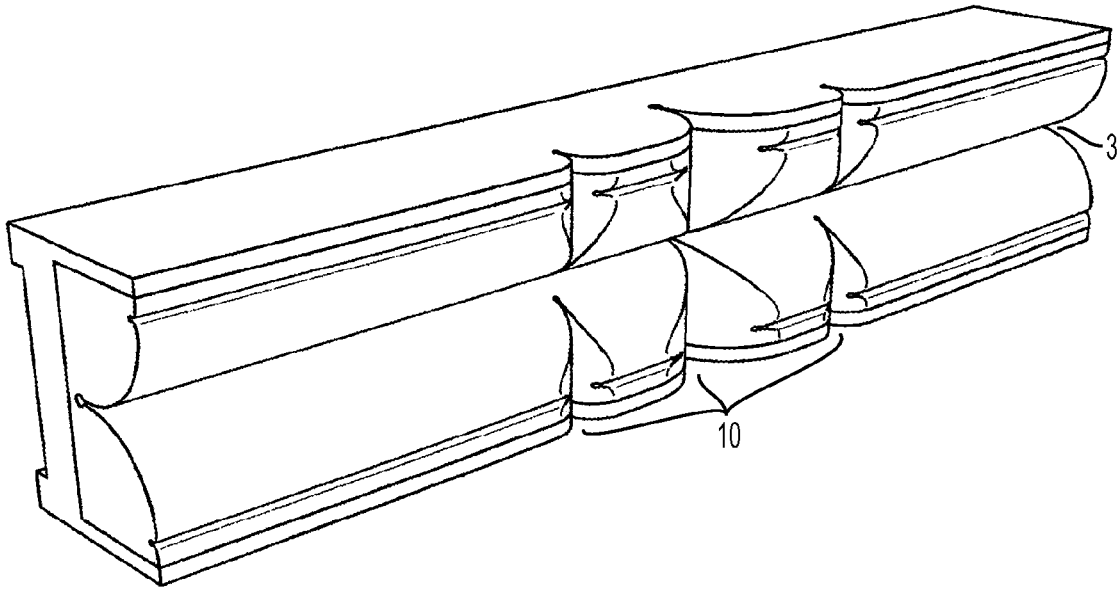

FIG. 12 shows a seventh embodiment of the present invention which is preferably intended to be used as an accessory to a vise. In this embodiment the accessory is fitted with at least one first groove 3 and at least a second parallel groove 10. FIGS. 13 and 14 show an eighth embodiment of the present invention where the grooves 3 and 10 are preferably angled at 90 degrees in relation to each other. Within the scope of the invention this angle may vary if the use of the accessory demands another angle. This design allows for greater accessibility to an object held in the accessory.

Figure 15:
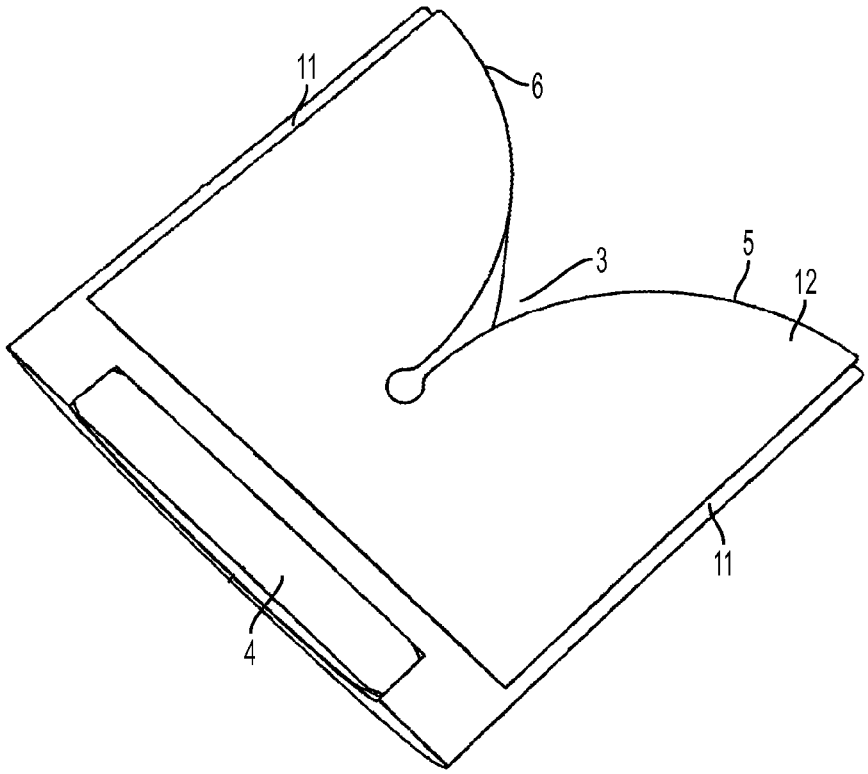
FIG. 15 shows a ninth embodiment of the present invention.

FIG. 15 shows a ninth embodiment of the present invention. This embodiment is unique because the body 2 is comprised of an outer covering 11 in which an exchangeable body 12 is designed to be inserted. This design allows for the possibility to adjust the size of the groove after specific needs of groove size. If the need exists for a relatively shallower groove, a body 12 fitted with such a groove is inserted in the covering. If the need exists for a relatively deeper groove, a body 12 with such a groove is inserted in the covering.

Figure 16:
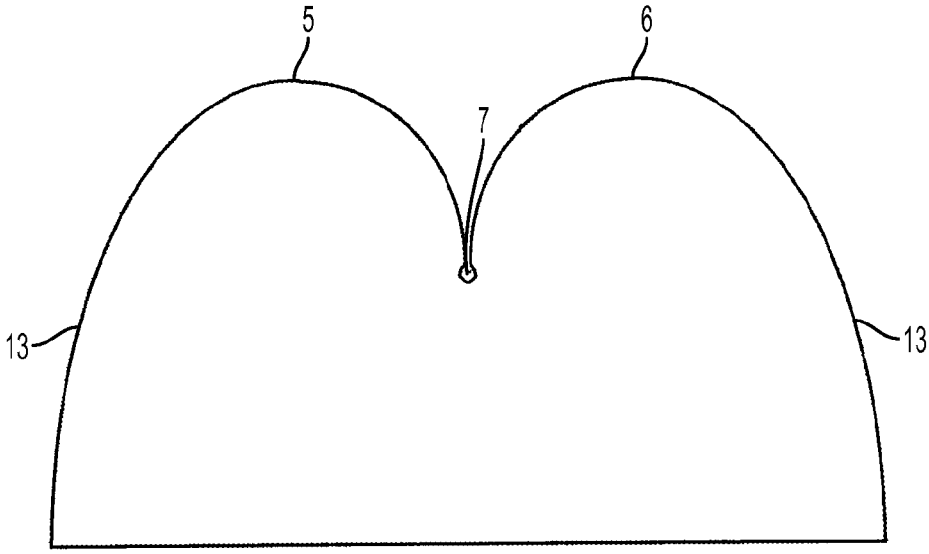
FIG. 16 shows a tenth embodiment of the present invention.

FIG. 16 shows a tenth embodiment of the present invention where the outer surface 13 has an elliptical form. This embodiment can be used to hold a pipe by way of the elliptical form being put into either a pipe's end openings or for example a gutter-like pipe's opening along its length, whereby the pipe is centered between the first and the second accessory. The outer elliptical form allows for an efficient clamping of for example short pipes, gutter pipes or other objects with an opening along its length.

Figure 17:
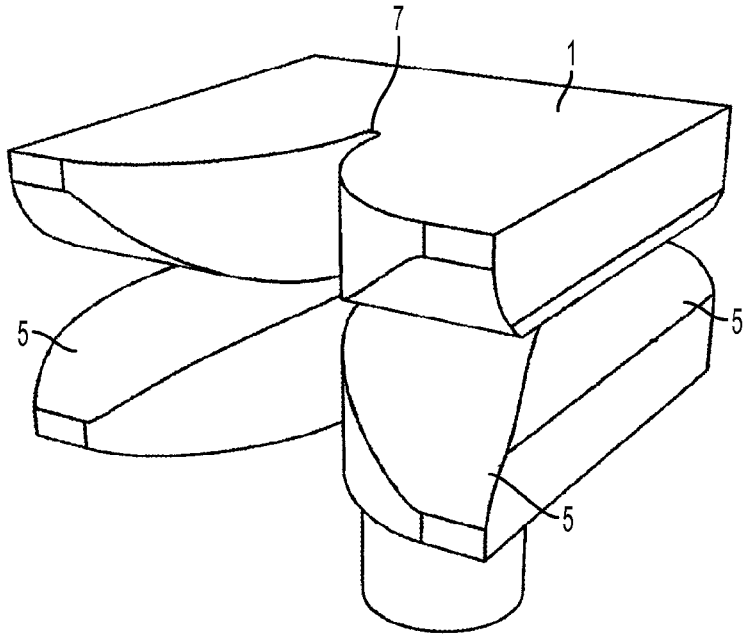
FIG. 17 shows an eleventh embodiment of the present invention.
Figure 18A:
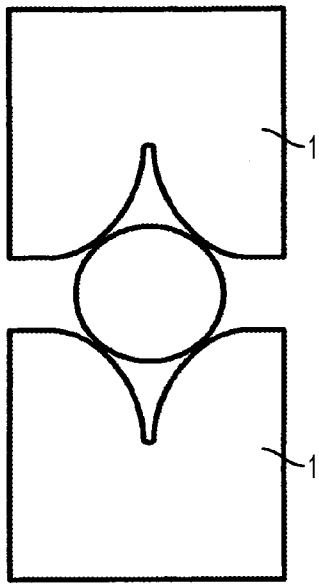
FIG. 18 shows several different types of objects being held by the present invention.
Figure 18B:
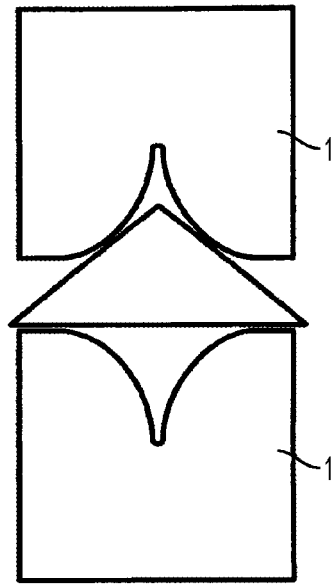
Figure 18C:
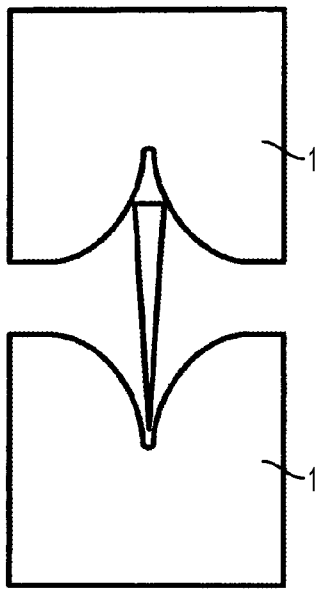
Figure 18D:
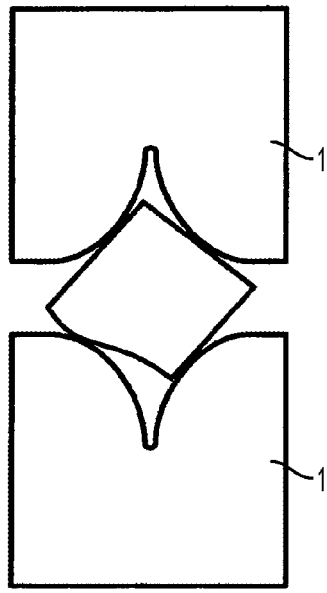
Figure 19A:
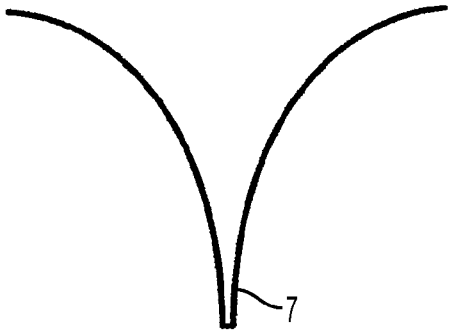
FIG. 19 shows alternative recessive forms.
Figure 19B:
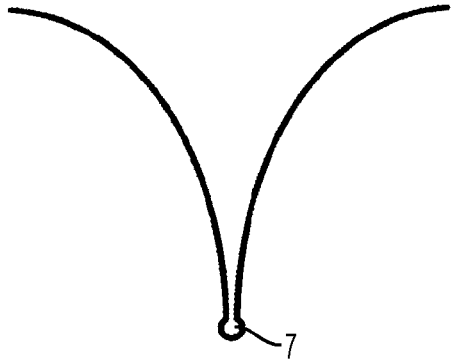
Figure 19C:
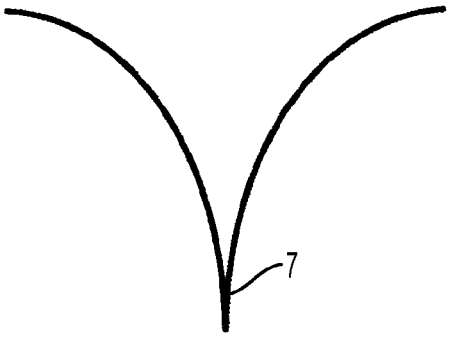
Figure 19D:
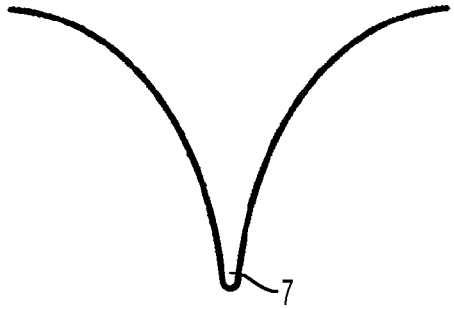

FIG. 17 shows an eleventh embodiment of the present invention. This embodiment functions as a work stop and is comprised of at least one, preferably three grooves 3. One and the same work stop can be used in a great variety of different applications on many different objects of varying shapes and sizes.

FIG. 18 shows several different types of objects being held by the present invention. The accessory allows for a plurality of forms and sizes to be held, for example round, triangular, thick, thin, long, symmetrical as well as asymmetrical.

FIG. 19 shows alternative recessive forms at the point where the contact surfaces merge. These alternative recessions allow for many different shapes and sizes of objects to be firmly held by the accessory.

Figure 20:
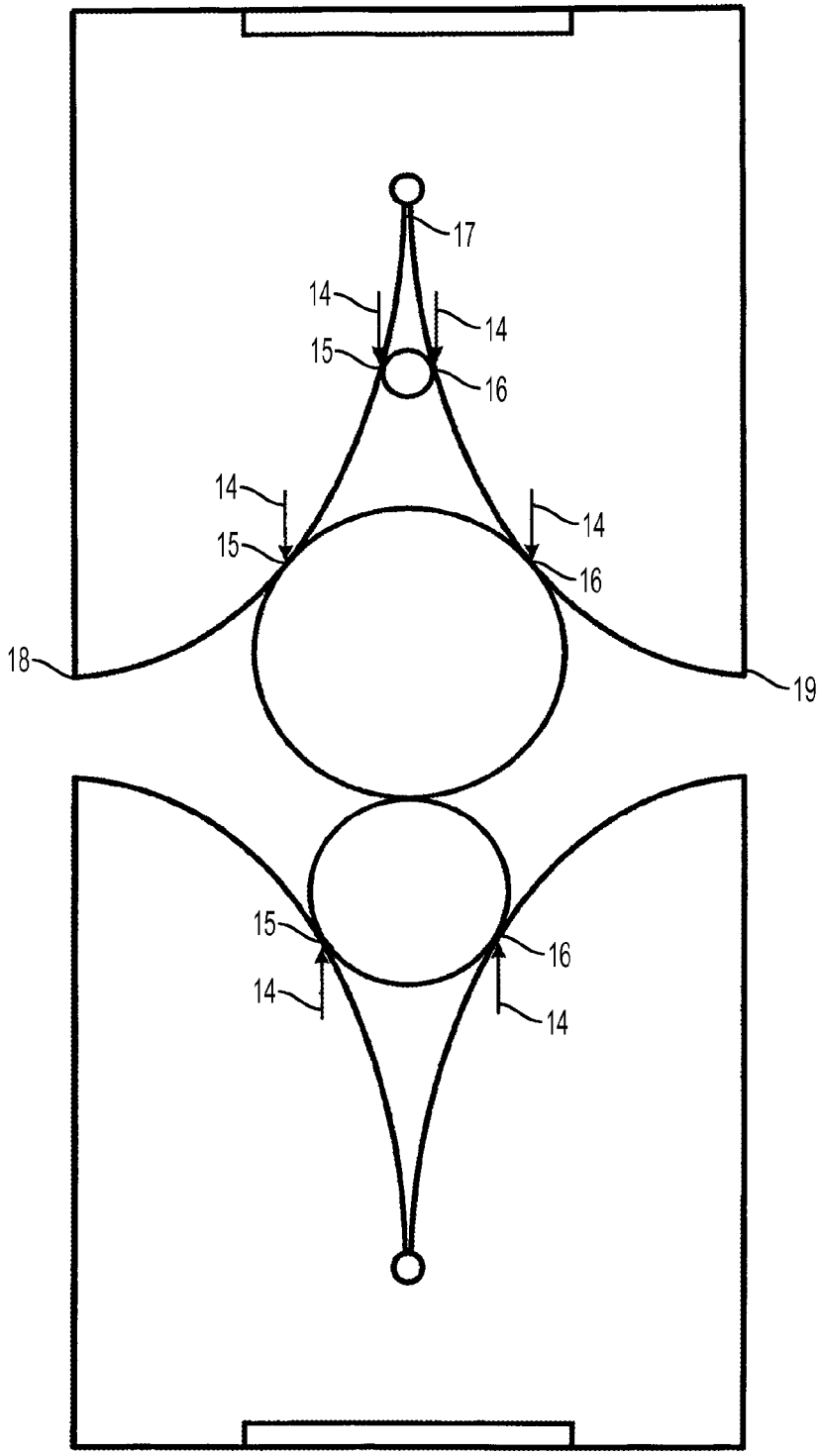
FIG. 20 shows the pressing vectors in relation to the size of the gripped object.

FIG. 20 shows the invention's ability to adjust the pressing vectors distance in response to the size and shape of the gripped object. The fact that the different objects command different distances of the pressing-vectors' mutual distance L, is a major generic problem of any gripping device. The accessory is designed to solve this generic problem by combining high functionality with simplicity of production, both achieved by the flexibility of the accessory and by implementing the distance L down to L=0. This advantage of the zero distance L, is a unique design of the accessory. The figure shows examples of the contact points between the accessory and the gripped object setting pressing vectors 14 in a parallel direction to the force axis of the holding device. The pressing vectors 14 change in a consecutive way in response to the geometries of the object. The arch-shaped design allows for a stepless adjustment of the pressing vectors' 14 mutual distance from L=0 to L maximum where L is the distance between the first contact point 15 and the second contact point 16. Point 17 is equivalent to L=0 and L maximum is the distance between 18 and 19.

Figure 21:
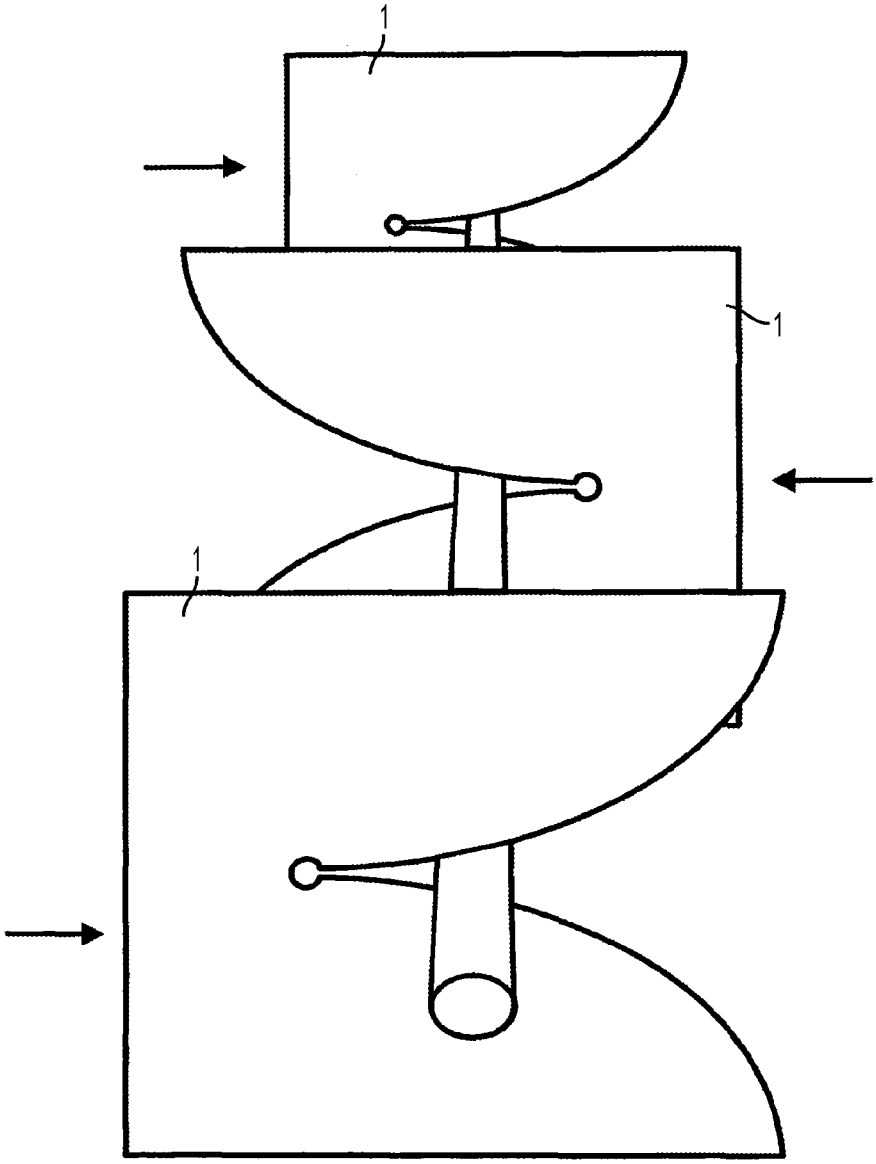
FIG. 21 shows the present invention gripping a long object with a small diameter.

FIG. 21 shows an example of how the present invention may be used to grip relatively long objects with small diameters. This application requires the use of at least three accessories where at least two of the accessories press in one direction while at least one accessory presses in the other direction so as not to bend the object.

It is even conceivable that an alternative embodiment may be comprised of at least two separate parts that can be joined together.

Even if certain preferred embodiments have been described in detail, variations and modifications can become evident for specialists in the field that the invention relates to. All such are regarded as falling within the scope of the present invention. In alternative embodiments the material for the jaws can for example be chosen with great liberty and adjusted to the existing need. Thus it is conceivable that the design may be used in other instances such as for example a press or the like. Furthermore the present invention may be used as an exclusive holder for an exclusive object during for example precision mechanical work or the like. The object in this case is not fastened with two jaws but rests in the groove. The object can then be held with one hand and be worked on by the other hand. Thus in yet other alternative embodiments it is conceivable that the present invention can consist of a work stop for a carpenter's work table or the like which allows for the object to be held against the accessory with one hand and be worked on by the other hand. Furthermore, the forms of the contact surfaces do not for example have to be symmetrical, of equal size or for that matter even smooth. The contact surfaces may for example have teeth and/or different kinds of indentations. It is even conceivable that one or both of the contact surfaces are linear in form.

ADVANTAGES OF THE INVENTION

The accessory is designed to solve the generic problem of combining high functionality with simplicity of production. The accessory's simplicity of production allows for it to be manufactured from a wide variety of materials. The accessory can also be manufactured in one piece which allows for production simplicity and reduced production costs. A significantly improved possibility of holding objects of greatly varied size and shape in a vise, a clamp or the like with one and the same accessory used in pairs is accomplished with the present accessory. It is also an advantage that the accessory is designed in such a way that it suitable for use with many different types of vises, clamps or similar devices and that no cumbersome adjustments in the accessory are required before work on the object begins. Still further the accessory facilitates the fastening of objects in for example a vise where it is sometimes difficult to fasten an object held only in one hand. Furthermore, small objects such as for example tools equipped with sharp edges like a knife or similar can be held without the edge being damaged. Still further, the embodiment with a magnet allows for the accessory to be easily moved from one holding device to another holding device, which allows it to function as an autonomous gripping device. On the other hand, the accessory can for example be manufactured as the final element in a gripping device. In this form the accessory is an integrated gripping element rather than an autonomous one. Yet another advantage with the accessory is that it includes a protecting layer which protects the object held from being damaged.

A further advantage of the design is that it does not consist of any moving parts making it inexpensive to manufacture and virtually unsusceptible to damage brought about by dust, shavings and other particles that are produced during working.

Because objects with very different forms can be held firmly by the invention in a much improved way, the risk of objects slipping out from for example a vise during working is minimized. Unnecessary damages to the object can in this way be avoided and work becomes more efficient when reclamping does not need to be carried out. Furthermore the risk of personal injury is reduced when objects can be held in place in a more secure way. Personal injury reduction is achieved by objects being hindered from slipping out of for example a vise and hitting persons working on the object or persons in the immediate vicinity and that slippage in itself can cause working tools and other things to cause personal injury.

What is claimed is:

1. An accessory for a holding device comprising:

a plurality of bodies each having at least first and second elongated arch-shaped contact surfaces that face each other and that are in spaced relation to define at least one groove there-between and at least one attachment device for attaching the body to a jaw of a vise or clamp, wherein the arch-shaped contact surfaces of all the bodies are constructed and arranged such that, when the bodies are provided between jaws of a vise or clamp or alike and an object is placed between the bodies, portions of the contact surfaces of at least two of the bodies engage the object clamping the object between the bodies upon closing of the jaws.

2. The accessory of claim 1, wherein the groove has a length of at least two millimeters.

3. The accessory of claim 1, wherein each of the arch shaped surfaces of the bodies includes a segment of a cylinder.

4. The accessory of claim 1, wherein each of the arch shaped surfaces of the bodies includes an elliptical form.

5. The accessory of claim 1, further comprising a recess at a location where ends of the contact surfaces meet.

6. The accessory of claim 5, wherein the recess is substantially of round form.

7. The accessory of claim 1, wherein the body comprises an elastic material that is sufficiently flexible for pressing vectors a mutual distance to shape itself after an object is gripped between at least to bodies.

8. The accessory of claim 1, wherein the attachment device includes at least one magnetic body.

9. The accessory of claim 1, wherein the groove is constructed and arranged to receive a large object and the accessory further comprises a second grove in each of the contact surfaces constructed and arranged to receive an object that is smaller than the large object.

10. The accessory of claim 1, wherein at least part of the contact surfaces are made of flexible material.

11. The accessory of claim 1, wherein the contact surfaces converge so as to be joined at ends thereof.

12. The accessory of claim 1, further comprising a protective layer over at least part of the contact surfaces.

13. A vise or clamp comprising:

at least one first jaw;

at least one second jaw;

means for moving the first jaw closer to the second jaw;

a first body having first and second elongated arch-shaped contact surfaces that face each other and that are in spaced relation to define at least one groove there-between, the first body being mounted on the first jaw; and a second body having third and fourth elongated arch-shaped contact surfaces that face each other and that are in spaced relation to define at least one groove there-between, the second body being mounted on the second jaw, wherein the arch-shaped contact surfaces of bodies are constructed and arranged such that when an object is placed between the bodies, portions of the contact surfaces of the bodies engage the object clamping the object between the bodies upon closing of the jaws.

14. The vise or clamp according to claim 13, further comprising a work table on which the vise or clamp is mounted.

15. The vise or clamp according to claim 13, further comprising a third jaw and a third body having fifth and sixth elongated arch-shaped contact surfaces that face each other and that are in spaced relation to define at least one groove there-between, the third body being mounted on the third jaw, wherein the arch-shaped contact surfaces of bodies are constructed and arranged such that when an object is placed between the bodies, portions of the contact surfaces of the bodies engage the object clamping the object between the bodies upon closing of the jaws.

16. A method of clamping a knife, tool or any other object having a sharp edge in a vise or clamp comprising:

at least one first jaw;

at least one second jaw opposing the first jaw;

means for moving the first jaw closer to the second jaw;

a first body having first and second elongated arch-shaped contact surfaces that face each other and that are in spaced relation to define at least one groove there-between, the first body being mounted on the first jaw; and a second body having third and fourth elongated arch-shaped contact surfaces that face each other and that are in spaced relation to define at least one groove there-between the second body being mounted on the second jaw, the method comprising:

placing a knife, tool or object having a sharp edge between the first and second bodies; and moving the first jaw closer to the second jaw so that portions of the contact surfaces of the bodies engage the knife or tool clamping the knife, tool or object between the bodies so that the sharp edge is not damaged.

17. The method according to claim 16, wherein the vise or clamp further comprises a third jaw and a third body having fifth and sixth elongated arch-shaped contact surfaces that face each other and that are in spaced relation to define at least one groove there-between, the third body being mounted on the third jaw, and the method further comprising moving the first, second and third jaws so that portions of the contact surfaces of the bodies engage the knife, tool or object clamping the knife, tool or object between the bodies so that the sharp edge is not damaged.

* * * * *